US009347224B1

(12) United States Patent
Nabil Ahmed

(10) Patent No.: US 9,347,224 B1
(45) Date of Patent: May 24, 2016

(54) STEP-BLOCK PRECAST STAIR

(71) Applicant: UMM AL-QURA UNIVERSITY, Makkah (SA)

(72) Inventor: Khaled I. Nabil Ahmed, Makkah (SA)

(73) Assignee: Umm Al-Qura University, Makkah (SA)

( * ) Notice: Subject to any disclaimer, the term of this patent is extended or adjusted under 35 U.S.C. 154(b) by 0 days.

(21) Appl. No.: 14/641,102

(22) Filed: Mar. 6, 2015

Related U.S. Application Data

(60) Provisional application No. 62/101,812, filed on Jan. 9, 2015.

(51) Int. Cl.

| | |
|---|---|
| ***E04F 11/035*** | (2006.01) |
| ***E04F 11/116*** | (2006.01) |
| ***E04F 11/09*** | (2006.01) |
| ***E04F 11/022*** | (2006.01) |
| ***E04B 2/22*** | (2006.01) |
| ***E04B 2/08*** | (2006.01) |
| *E04F 11/02* | (2006.01) |

(52) U.S. Cl.
CPC ..... *E04F 11/035* (2013.01); *E04B 2/08* (2013.01); *E04B 2/22* (2013.01); *E04F 11/0223* (2013.01); *E04F 11/09* (2013.01); *E04F 11/116* (2013.01); *E04F 2011/0212* (2013.01)

(58) Field of Classification Search
CPC ..... E04F 11/035; E04F 11/09; E04F 11/116; E04F 11/0223; E04F 2001/0223; E04B 2/04; E04B 2/08; E04B 2/12
USPC ..... 52/73, 184, 189, 190, 284, 574, 604, 52/611
See application file for complete search history.

(56) References Cited

U.S. PATENT DOCUMENTS

| | | | | | |
|---|---|---|---|---|---|
| 479,054 | A | * | 7/1892 | Briggs | E04B 2/42 52/284 |
| 829,480 | A | * | 8/1906 | Mills | E01C 5/00 404/41 |
| 1,097,148 | A | * | 5/1914 | Swanson | E04B 2/04 52/284 |
| 1,201,408 | A | * | 10/1916 | White | E04B 2/22 52/284 |
| 1,336,718 | A | * | 4/1920 | Barksdale | E04F 11/022 52/190 |
| RE14,904 | E | * | 6/1920 | Wheeler | E01C 5/00 404/34 |
| 1,358,055 | A | * | 11/1920 | Burke | E04B 2/42 52/504 |
| 1,398,695 | A | | 11/1921 | Hull | |
| 1,842,828 | A | * | 1/1932 | Giuliani | E04B 2/56 52/284 |
| 2,900,814 | A | * | 8/1959 | Carson | E04B 2/22 138/92 |
| 3,252,287 | A | | 5/1966 | Suzuki | |
| 3,418,774 | A | * | 12/1968 | Kocher | E04B 2/22 52/437 |

(Continued)

FOREIGN PATENT DOCUMENTS

| | | | |
|---|---|---|---|
| DE | 2748039 | A1 | 5/1979 |
| DE | 202007010424 | U1 | 10/2007 |

(Continued)

*Primary Examiner* — Robert Canfield
(74) *Attorney, Agent, or Firm* — Oblon, McClelland, Maier & Neustadt, L.L.P.

(57) ABSTRACT

A precast step-wall block including a step portion projecting perpendicularly out of a wall system and a wall block portion, is disclosed. Wall blocks used in constructing the wall system are T-shaped in plan view with exemplary dimensions of 400 mm×200 mm×200 mm. These wall blocks are arranged in Flemish bond courses to facilitate the projection of the precast steps from the wall system. A mold designed for preparation of the precast steps of different lengths is also described.

23 Claims, 7 Drawing Sheets

(56) References Cited

U.S. PATENT DOCUMENTS

| | | | | | |
|---|---|---|---|---|---|
| 3,805,464 | A | | 4/1974 | Hanson | |
| 3,913,292 | A | * | 10/1975 | Braekkan | E04B 1/6104 52/241 |
| 3,998,022 | A | * | 12/1976 | Muse | E04B 2/44 52/564 |
| 4,123,881 | A | | 11/1978 | Muse | |
| 4,248,020 | A | | 2/1981 | Zielinski et al. | |
| 4,633,630 | A | * | 1/1987 | Kindylides | E04B 2/50 52/204.2 |
| 4,995,205 | A | | 2/1991 | Bennett | |
| 5,491,939 | A | | 2/1996 | Wang | |
| 6,286,287 | B1 | * | 9/2001 | Dieter | B27M 3/0053 446/115 |
| 7,469,516 | B2 | | 12/2008 | Smith | |
| 8,201,376 | B2 | * | 6/2012 | Witcher | E04C 1/395 52/565 |
| 8,266,855 | B1 | * | 9/2012 | Altararwah | E04B 2/12 52/275 |
| 2014/0026511 | A1 | | 1/2014 | Binns | |

FOREIGN PATENT DOCUMENTS

| | | | |
|---|---|---|---|
| ES | 2424814 | T3 | 10/2013 |
| FR | 2801620 | A1 | 6/2001 |
| IE | S66317 | | 12/1995 |

* cited by examiner

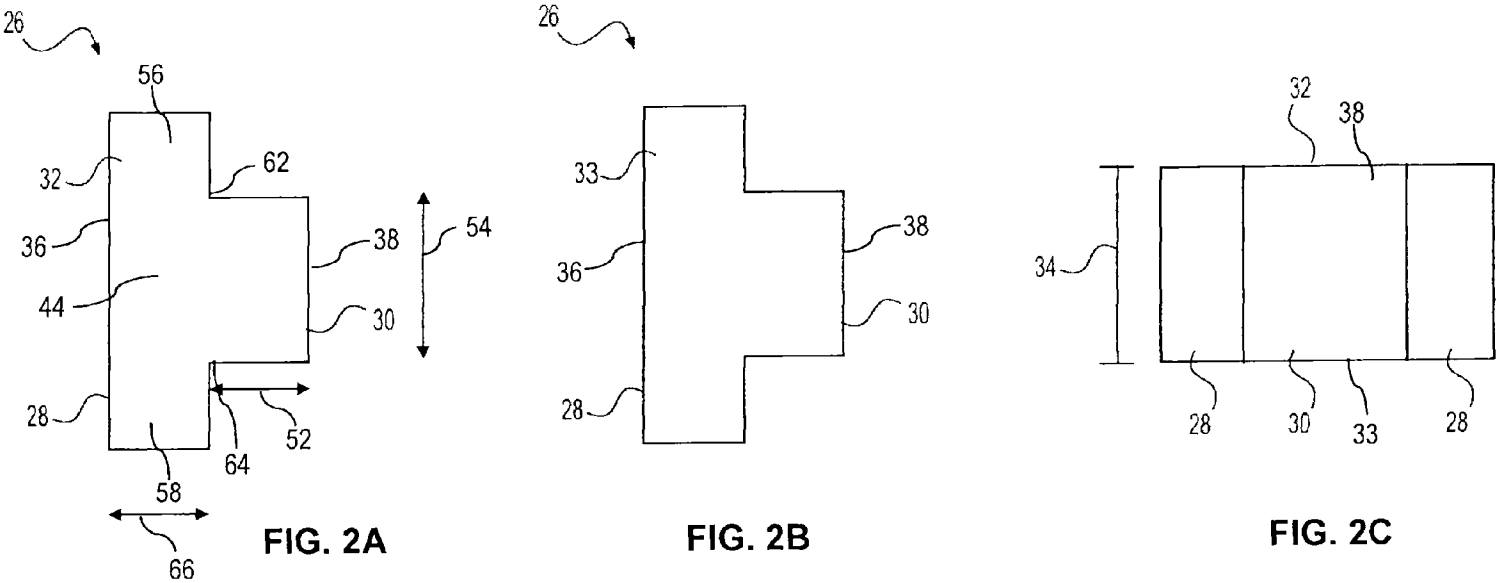
FIG. 2A
FIG. 2B
FIG. 2C
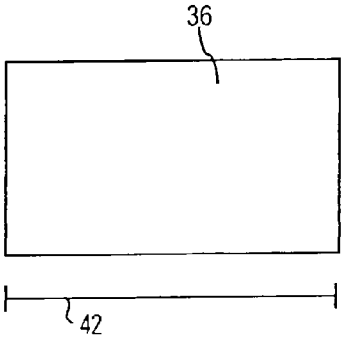
FIG. 2D
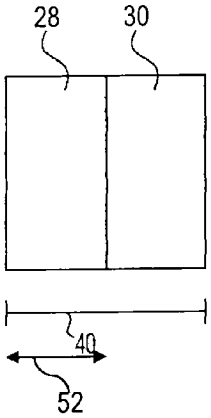
FIG. 2E

STEP-BLOCK PRECAST STAIR

CROSS-REFERENCE TO RELATED APPLICATIONS

This application claims the benefit of priority from U.S. Provisional Application No. 62/101,812, filed Jan. 9, 2015, the entire contents of which are incorporated herein by reference.

BACKGROUND OF THE INVENTION

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Conventional staircases are constructed on-site through a reinforced concrete structure or a steel structure. Installation of on-site cast concrete staircases is a very difficult and time-consuming operation in traditional concrete skeleton structures. The process requires scaffolding, steel cutting, reinforcement and concrete molding and de-molding, which can cost as much as 8-10% of the building with its finishes.

Thus, many construction companies and builders have tried to improve the stair building process by using precast concrete staircases, to be quick and clean with the added benefit that the units can be used as soon as they are installed. However, a full flight of precast concrete stairs is heavy, requiring large cranes for transportation. Furthermore, the full flight of precast stairs may not be suitable for small projects and owner-builders.

Attempts in the prior art to improve the practicality of precast staircases include splitting the whole staircase into heavy components (see U.S. Pat. No. 4,248,020 to Zielinski, U.S. Pat. No. 4,995,205 to Bennett, U.S. Pat. No. 3,805,464 to Hanson and U.S. Pat. No. 5,491,939 to Wang—each incorporated by reference herein in its entirety).

Others have tried to minimize the weight of precast components by turning the stair flights into modular longitudinal units (see U.S. Pat. No. 7,469,516 to Smith—incorporated by reference herein in its entirety) which is nevertheless fraught with constructional complexities.

From the foregoing, it will be desirable to provide a staircase and a method of manufacturing thereof which is strong, safe, economical, of relatively light weight, facilitates a simple installation for unskilled labor and self-builders. Limitations and disadvantages of the prior art are overcome by the various disclosed embodiments of the present invention.

BRIEF SUMMARY OF THE INVENTION

The foregoing paragraphs have been provided by way of general introduction, and are not intended to limit the scope of the following claims. The described embodiments, together with further advantages, will be best understood by reference to the following detailed description taken in conjunction with the accompanying drawings.

In a first embodiment, a construct unit may include a wall system having a plurality of T-shaped wall blocks arranged in a plurality of horizontal courses in Flemish bond, each of the T-shaped wall blocks having a main body portion, a side body portion and first and second intersecting corners, the main body portion having a rectangular cross section, a central portion, a first arm and a second arm extending horizontally from the central portion in opposing directions. The side body portion may have a square cross section emanating vertically from the central portion. The first and second intersecting corners may be disposed between the main body portion and the side body portion on both sides of the side body portion. The first and second intersecting corners may be disposed between the main body portion and the side body portion on both sides of the side body portion. Each of the T-shaped wall blocks, through the first and second arms, connects securely with the intersecting corners of two adjacent T-shaped wall blocks that are in the opposite orientation in the horizontal courses so that alternate T-shaped blocks in the horizontal courses have rectangular side surfaces and square side surfaces facing outward and square side surfaces in a first horizontal course are disposed in the middle of rectangular side surfaces of a second horizontal course below the first horizontal course.

In a second embodiment, a precast concrete step may include a horizontal tread portion, a vertically arranged riser portion connected integrally to the tread portion at 90° and depending from the tread portion and a T-shaped connecting portion connected integrally to the tread portion at 90° and depending from the tread portion and the riser portion.

Exemplary implementations of the present disclosure include:

A: A construction unit comprising:

a wall system having a plurality of T-shaped wall blocks arranged in a plurality of horizontal courses in Flemish bond, each of the T-shaped wall blocks having a main body portion, a side body portion and first and second intersecting corners, the main body portion having a rectangular cross section, a central portion, a first arm and a second arm extending horizontally from the central portion in opposing directions;

wherein:

the side body portion has a square cross section emanating vertically from the central portion;

the first and second intersecting corners are disposed between the main body portion and the side body portion on both sides of the side body portion;

each of the T-shaped wall blocks, through the first and second arms, connects securely with the intersecting corners of two adjacent T-shaped wall blocks that are in the opposite orientation in the horizontal courses so that alternate T-shaped blocks in the horizontal courses have rectangular side surfaces and square side surfaces facing outward and square side surfaces in a first horizontal course are disposed in the middle of rectangular side surfaces of a second horizontal course below the first horizontal course.

B: The construction unit of A, wherein each of the T-shaped wall blocks has dimensions of 400×200×200 mm (length×width×height).

C: The construction unit of A, further comprising:

a stair system comprising a plurality of precast concrete steps, each of the precast concrete steps including a generally horizontal tread portion, a generally vertically arranged riser portion connected integrally to at 90° and depends from the tread portion and a T-shaped connecting portion connected integrally to at 90° and depends from the tread portion and the riser portion, the T-shaped connecting portion has dimensions equal to the T-shaped wall block; each of the precast steps is installed in the direction of going of the stair system by substituting a T-shaped wall block having the rectangular side surface outward with the connecting portion so that the tread portion and the riser portion project perpendicularly out of the wall system.

D: The construction unit of A, wherein the tread portion further includes a nosing portion.

E: The construction unit of C, wherein the tread portion is 350-400 mm in width, 50 mm in height and 600-1200 mm in length.

F: The construction unit of C, wherein the riser portion is 50 mm in width, 200 mm in height and 600-1200 mm in length.

G: The construction unit of E, wherein the width is adjusted during casting with a casting apparatus.

H: The construction unit of F, wherein the width is adjusted during casting with a casting apparatus.

I: The construction unit of E, wherein the length is adjusted during casting with a casting apparatus.

J: The construction unit of F, wherein the length is adjusted during casting with a casting apparatus.

K: A precast concrete step comprising:

a horizontal tread portion;

a vertically arranged riser portion connected integrally to the tread portion at 90° and depending from the tread portion; and a T-shaped connecting portion connected integrally to the tread portion at 90° and depending from the tread portion and the riser portion.

L: The precast step of K, wherein the tread portion further includes a nosing portion.

M: The precast step of K, wherein the tread portion is 350-400 mm in width, 50 mm in height and 600-1200 mm in length.

N: The precast step of K, wherein the riser portion is 50 mm in width, 200 mm in height and 600-1200 m in length.

O: The precast step of K, wherein the width is adjusted during casting with a casting apparatus.

P: The precast step of L, wherein the width is adjusted during casting with a casting apparatus.

Q: The precast step of K, wherein the length is adjusted during casting with a casting apparatus.

R: The precast step of L, wherein the length is adjusted during casting with a casting apparatus.

S: The precast step of K, wherein the connecting portion comprises:

a main body portion having a rectangular cross section, a central portion, a first arm and a second arm extending horizontally from the central portion in opposing directions;

a side body portion having a square cross section emanating vertically from the central portion; and first and second intersecting corners disposed between the main body portion and the side body portion on both sides of the side body portion.

T: The precast step of S, wherein the T-shaped wall block has dimensions of 400×200×200 mm (length×width×height).

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 2A provides a top plan view of a T-shaped wall block, according to one embodiment.

FIG. 2B provides a bottom plan view of the T-shaped wall block of FIG. 2A.

FIG. 2C provides a front perspective view of the T-shaped wall block of FIG. 2A.

FIG. 2D provides a back perspective view of the T-shaped wall block of FIG. 2A.

FIG. 2E provides a side perspective view of the T-shaped wall block of FIG. 2A.

DETAILED DESCRIPTION OF THE EMBODIMENTS

Figure 1A:
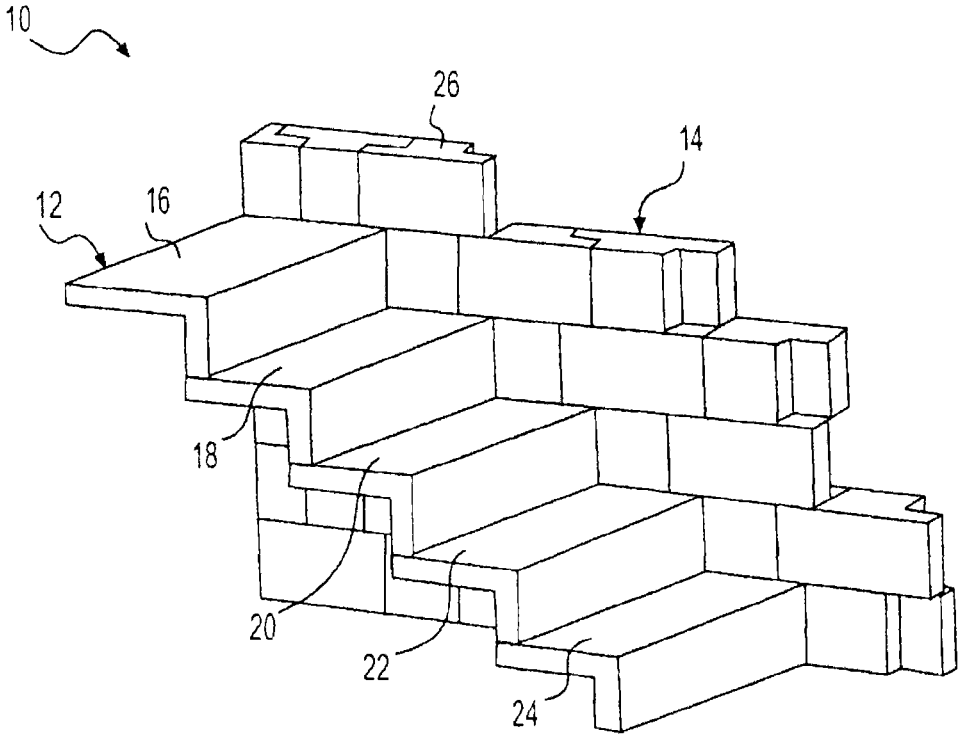
FIG. 1A provides an isometric view of the stair/wall structural model according to one embodiment.

Referring now to the drawings, wherein like reference numerals designate identical or corresponding parts throughout the several views.

Conventional vernacular steps are fraught with multiple shortcomings, for example, being extremely heavy, requiring highly-skilled labor and excessive construction time. What follows, in part, is a description of converting a flight of stairs into separate precast steps projecting perpendicularly out of a wall in one, single unit, where there is no need to insert and fix the precast steps into the wall. In selected embodiments, the wall block may be T-shaped, in plan, with specific dimensions. Therefore, the stair may be installed by building the adjacent wall as one simple operation. In one example, wall blocks may be arranged in Flemish bond, which requires minimal masonry skills.

In one embodiment, a precast stair-wall construction unit 10 as shown in FIGS. 1Aa (isometric view) and 1B (top plan view) may include a flight 12 and a wall system 14. The flight 12 is a stair system which further includes a plurality of precast steps, for example, steps 16, 18, 20, 22 and 24 that project perpendicularly out of the wall system 14. In other words, the wall system is utilized as a load-bearing structure that holds precast steps, therefore giving the stair system the necessary strength that meets building safety requirements.

Figure 1B:
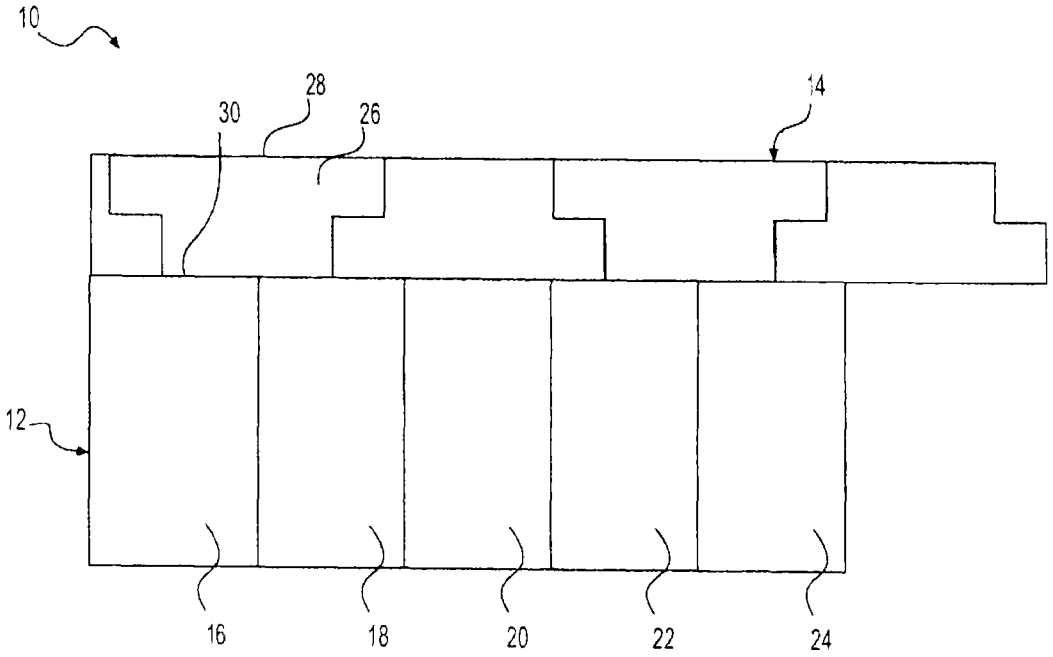
FIG. 1B provides a top plan view of the stair/wall structural model of FIG. 1A.

Still referring to FIGS. 1A, 1B, the wall system 14 is built of a plurality of wall block units that are laid in and bound together by mortar. Constructive materials for the wall blocks include but are not limited to, for example, brick, stone, marble, travertine, limestone, cast stone, concrete block, glass block, stucco, tile and cob.

In one embodiment, the wall blocks assume a symmetrical T-shaped configuration. As can be seen in FIGS. 2A-2E, a T-shaped wall block 26 includes a main body portion 28 and a side body portion 30, both of which may be rectangular in exterior shape. Main body portion may further include central portion 44 and arms 56, 58. The wall block 26 may also include a T-shaped, top surface 32, bottom surface 33 which is opposite from the top surface at a distance, 34. The distance 34 constitutes the height of the wall block and may be 200 mm in one embodiment. Top surface 32 and bottom surface 33 may be generally flat. The wall block 26 may further include a rectangular side surface 36 with, in one embodiment, a dimension of 400 mm×200 mm and a square side surface 38 with the dimensions of 200 mm×200 mm. These two side surfaces are opposite to each other with a distance, 40, of, in one embodiment, 200 mm between them. The distance 40 constitutes the thickness or width of the wall block. The length of the wall block, 42, may be 400 mm. Thus, in one embodiment, the wall block 26 has the dimensions of 400 mm×200 mm×200 mm (length×width×height).

As can be seen in FIG. 2A, side body portion 30 emanates vertically from central portion 44. In one embodiment, the width or thickness of the side body portion, 52, may be 100 mm and the length, 54, may be 200 mm. Thus, the dimensions may be 200 mm×100 mm×200 mm (length×width×height) for the side body portion 30.

At the main body portion, arms 56, 58 extend horizontally from central portion 44 in opposing directions. In one embodiment, in order uphold the symmetry of the wall block structure, the lengths of the arms, 56, 58 may be equal, with the side body portion 30 disposed in the middle between the arms. The intersection between main body portion 28 and side body portion 30 creates intersecting corners 62, 64. In the preferred embodiment, the length of the arms may be 100 mm. In one embodiment, the thickness of the main body portion, 66, may be substantially equal or equal to that of the side body portion (100 mm). Therefore, the dimensions of the main body portion may be 400 mm×100 mm×200 mm (length×width×height).

Figure 3B:
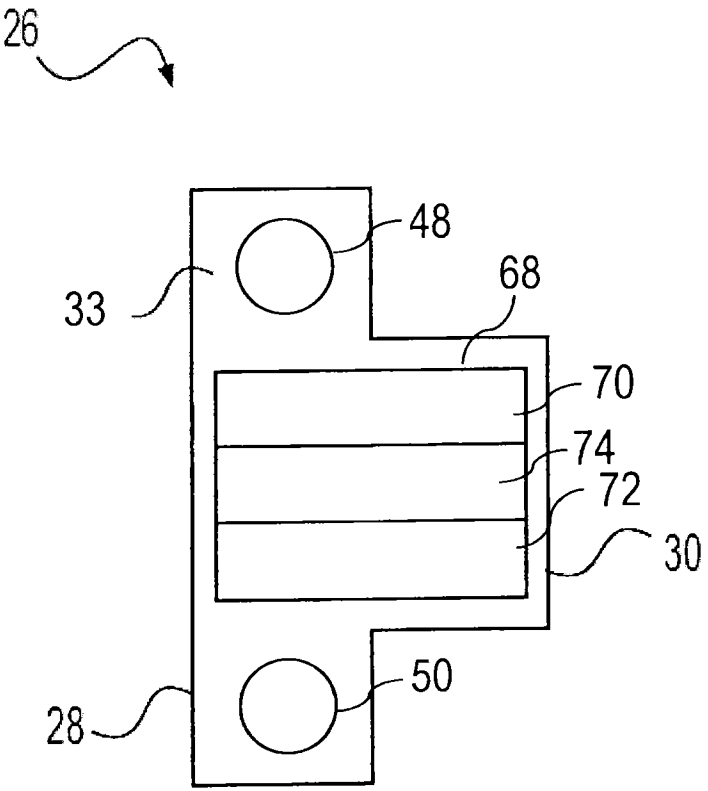
FIG. 3B provides a bottom plan view of the T-shaped wall block of FIG. 3A.
Figure 3A:
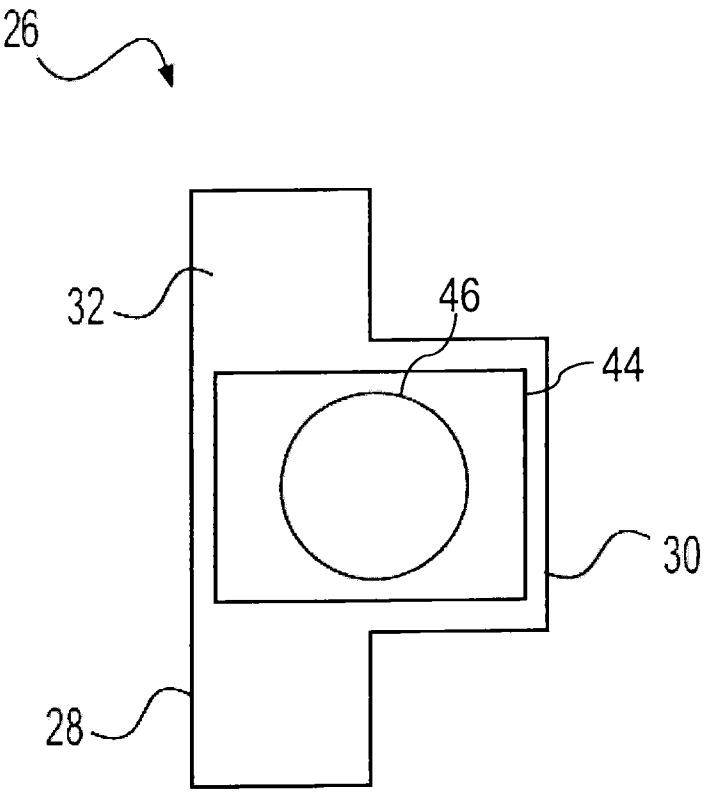
FIG. 3A provides a top plan view of a T-shaped wall block, according to one embodiment.

In an alternative embodiment, wall block 26 may have additional features as described below. Such features may be purely design choice or may also provide extra space for concrete sealing during construction. As shown in FIG. 3A, top surface 32 may further include top central portion 44 and top circular groove 46 disposed within the central portion. The top central portion may be rectangular with dimensions of 150-180 mm×150-180 mm. Circular groove 46 may have a diameter of 100-175 mm and a depth of up to 50 mm. Bottom surface 33, as shown in FIG. 3B, may further include bottom circular grooves 48, 50 on both arms of main body portion 28 and bottom central portion 68. Bottom circular grooves 48, 50 may each have a diameter of 50-75 mm and a depth of up to 50 mm. Bottom central portion 68 may be rectangular with dimensions of 150-180 mm×150-180 mm. The bottom central portion may further include middle portion 74 separating two rectangular grooves 70, 72. The rectangular grooves may have dimensions of 150-180 mm×50-75 mm.

To erect the wall system 14, the T-shaped wall blocks are arranged in Flemish bonds so that each horizontal course consists of alternate blocks having their short sides and long sides facing outward, with alternate courses being offset. As shown in FIGS. 1A and 1B, a first horizontal course of wall blocks is built by laying a plurality of wall blocks on their bottom surfaces upon a construction site. Within the course, every wall block is in an opposite orientation to an adjacent block and the same orientation as an alternate block. Therefore, each course consists of alternate blocks with their rectangular side surfaces and square side surfaces facing outward. With the unique dimensions of 400 mm×200 mm×200 mm, each wall block, through a main body portion arm, connects securely with an intersecting corner of an adjacent wall block in the opposite orientation. After completion of a first horizontal course of wall block, a second horizontal course is laid vertically upon the first course so that a square side surface in the middle of the rectangular side surface below (see FIG. 3). The Flemish bond pattern is preserved in subsequent horizontal courses that are laid vertically upon their previous course until a desired wall height. For example, a wall system consisting of eight horizontal courses of wall blocks has a height of 1600 mm (8×200 mm).

Figure 4A:
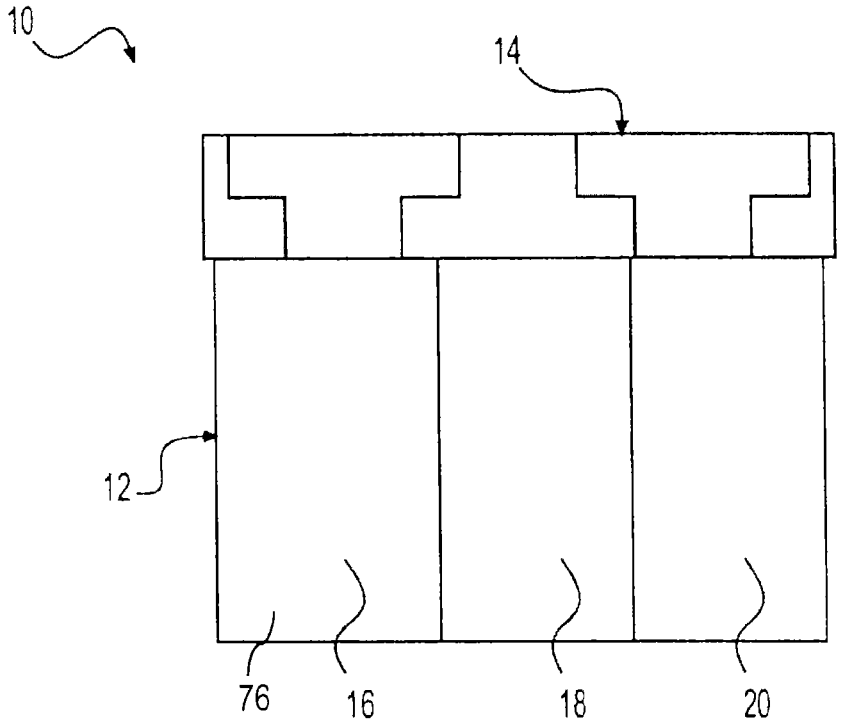
FIG. 4A provides a top plan view of the steps of a staircase projecting perpendicularly out of a wall installed in Flemish bond according to one example.
Figure 4B:
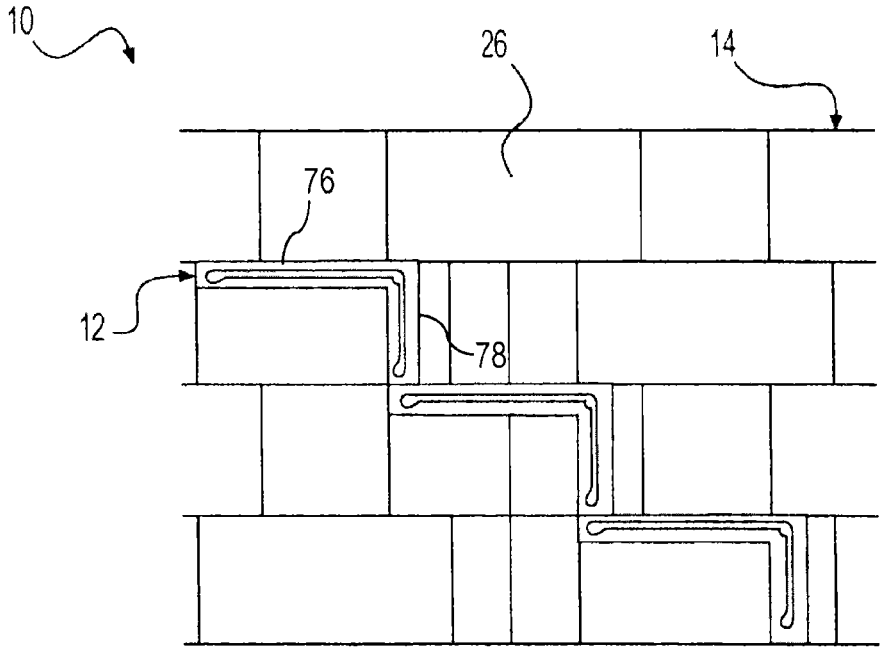
FIG. 4B provides a front perspective view of the stair/wall structural model of FIG. 4A.

FIGS. 4A and 4B offer a top plan view and a front elevation view of the stair-wall construction unit 10, respectively. As shown in FIGS. 4A and 4B, flight 12 projects perpendicularly out of wall system 14 and both components are erected simultaneously as one unit. A precast step substitutes a single wall block that has its rectangular side surface facing outward in every horizontal course in the direction of going of the flight.

Each precast step 20 includes a generally horizontally arranged tread portion 76 and a generally vertically arranged riser portion 78 that is connected integrally to at substantially 90° and depends from tread portion 76. To align with the dimensions of the wall blocks in the wall system, the tread portion 76 may be 350 mm in width and 50 mm in height. The length of the tread portion is flexible. Similarly, to agree with the dimensions of the wall blocks, the riser portion 78 may have a fixed height of 200 mm and a width of 50 mm. In one embodiment, tread portion 76 may extend outwardly beyond riser portion 78 to create a nosing portion to further increase space and strengthen stair-wall construction unit 10. The nosing portion may be 50 mm in width in one example.

Figure 5A:
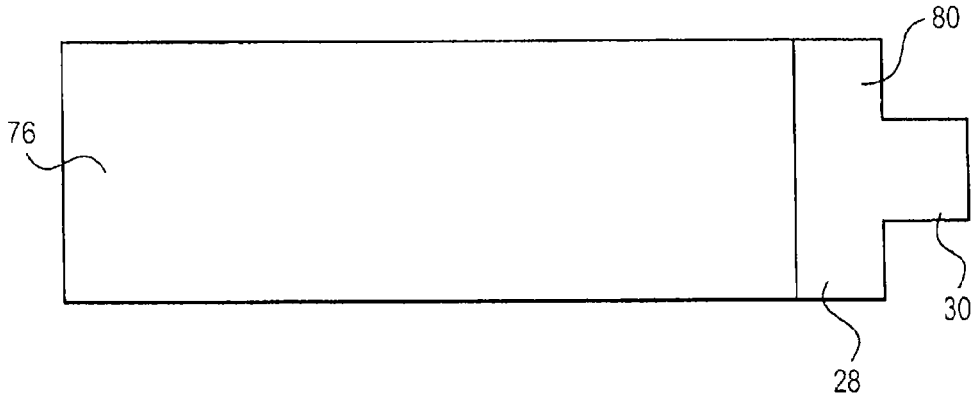
FIG. 5A provides a top plan view of a precast step with a T-shaped connecting portion according to one embodiment.
Figure 5B:
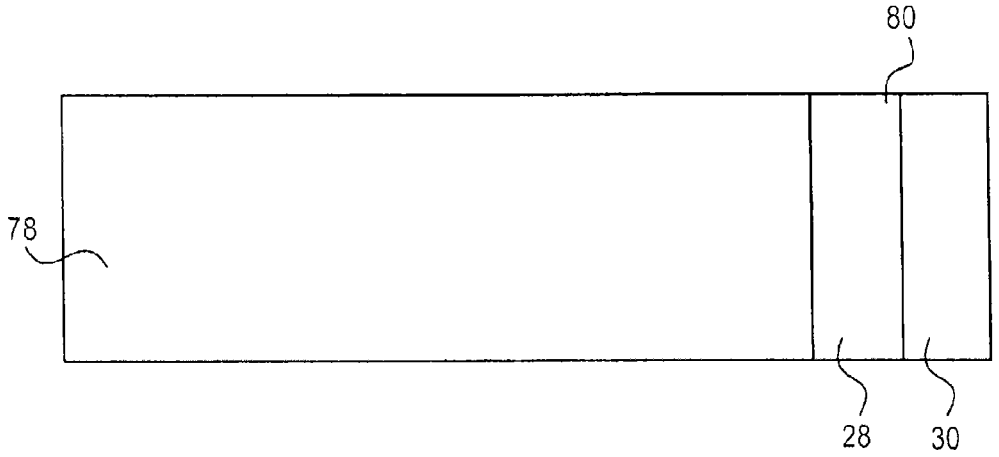
FIG. 5B provides a front perspective view of the precast step of FIG. 5A.
Figure 5C:
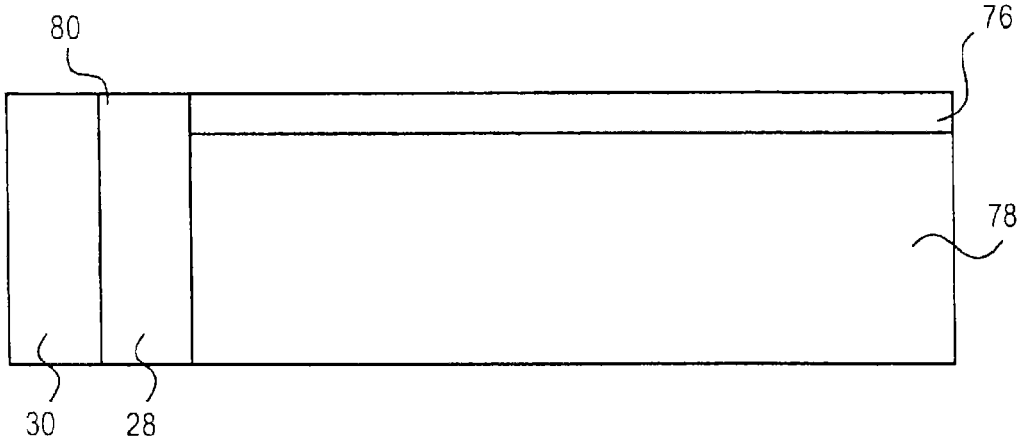
FIG. 5C provides a rear perspective view of the precast step of FIG. 5A.

Precast step 20 also includes T-shaped connecting portion 80 (see FIGS. 5A, 5B and 5C) with dimensions of 200 mm×400 mm×200 mm (length×width×height), which are equal to the dimensions of the aforementioned T-shaped wall blocks. Like T-shaped wall block 26, T-shaped connecting portion also includes main body portion 28 and side body portion 30 whose shape and dimensions have been previously described. The T-shaped connecting portion 80 is connected integrally to at substantially 90° and depends from tread portion 76 and riser portion 78. In an assembled stair-wall construction unit 10, connecting portion 80 is incorporated into wall system 14 as a wall block. Therefore, each installed precast step not only serves as a step in a flight of stair, but also a wall block in the wall system.

Figure 6A:
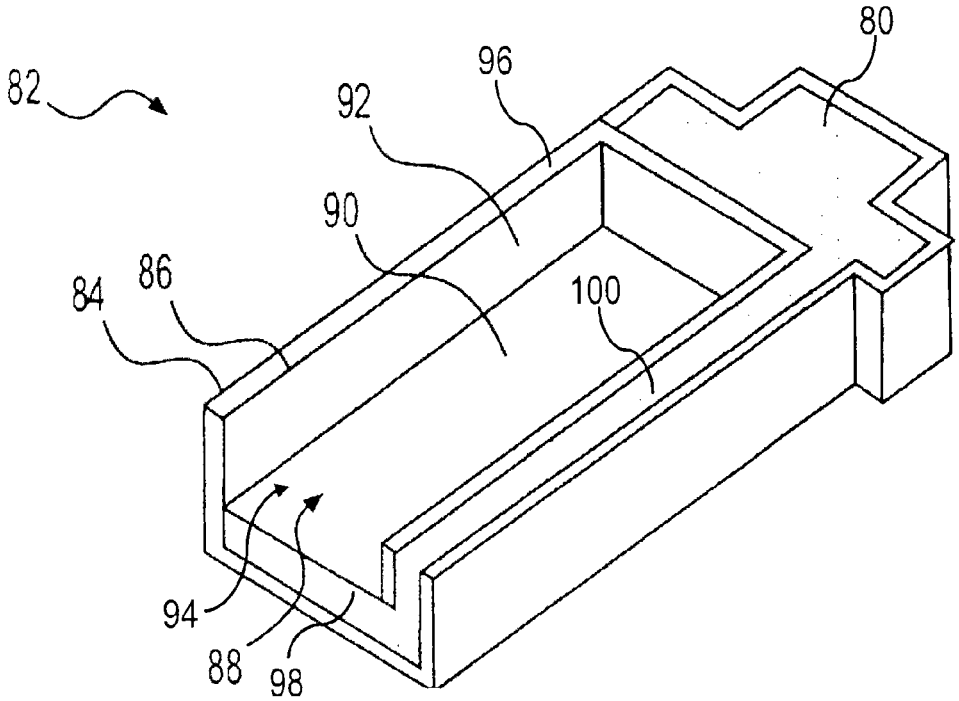
FIG. 6A provides an isometric view of the mold used to cast steps according to one example.
Figure 6B:
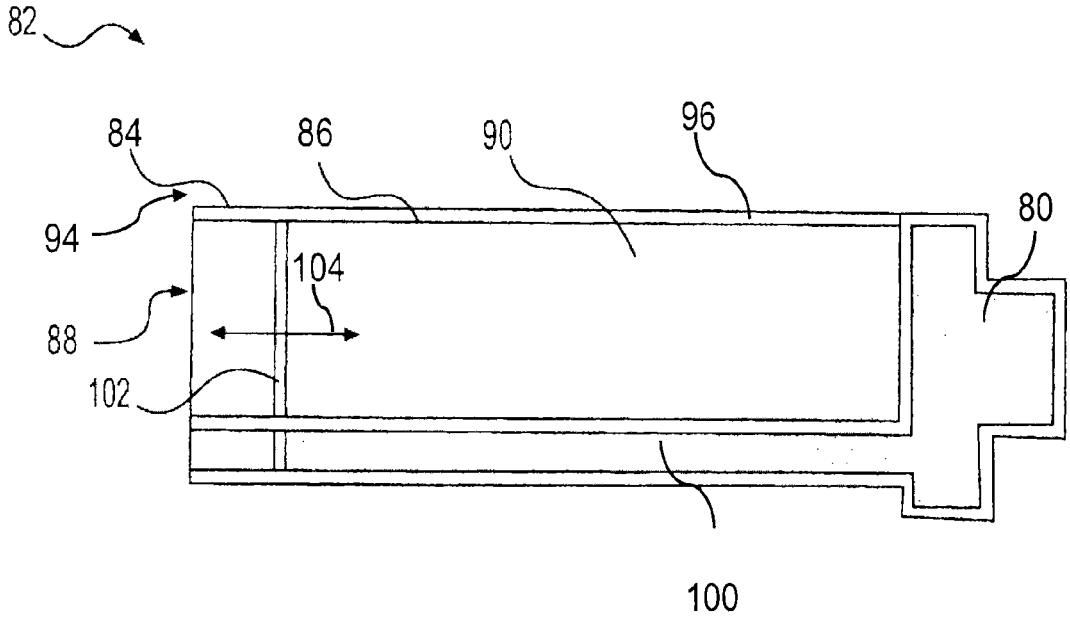
FIG. 6B provides a top plan view of the mold in FIG. 5*a* according to one embodiment.
Figure 7:
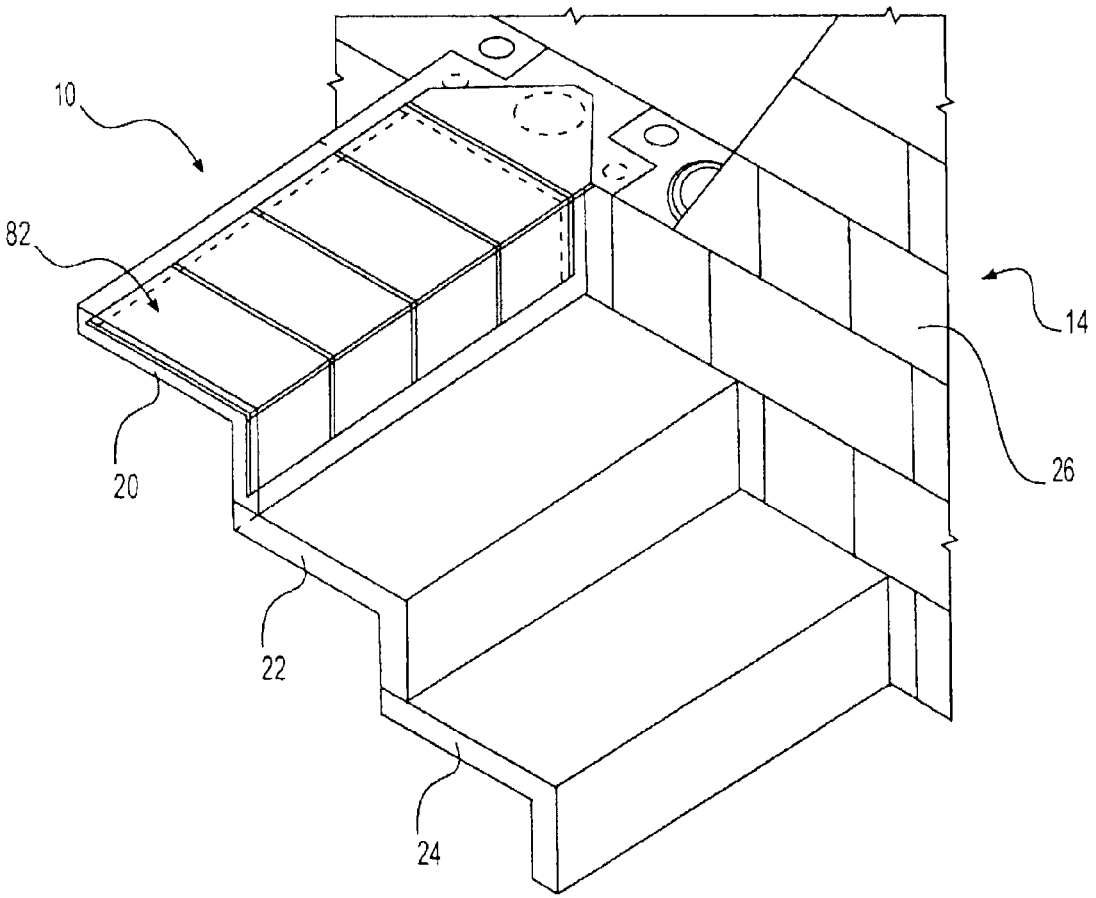
FIG. 7 illustrates the installation of a precast step according to one embodiment.

The disclosure on is also directed to a casting apparatus 82 as shown in FIGS. 6A, 6B and 7. Each precast step is cast and formed upside down. Casting apparatus 82 may be constructed of various types of material, for example, metal, plastic or wood.

As best shown in FIG. 6A, casting apparatus 82 includes two detachable components: frame 84 and mold 86. When the two components are assembled, frame 84 includes an open end 88, a cavity floor 90 which is a generally flat horizontal surface with a disposed width of 350 mm and a disposed length of 600 mm to 1200 mm. Frame 84 also includes first cavity wall 92 which is a generally flat vertical surface that is perpendicular to cavity floor 90 with a disposed height of 200 mm and a disposed length of 600 mm to 1200 mm. Mold 86 takes the form of a rectangular tray with open end 94 and is affixed to second cavity wall of the frame 96. Open ends 88, 94 should align with each other. The assembly will leave gaps 98, 100 that are 50 mm wide between mold 86 and frame 84.

To make a precast step 20, bar 102 is slid along the direction of double-headed arrow 104 to adjust and define the length of the step.

After defining the desired dimensions of precast step 20, liquid concrete mix 102 is poured into casting apparatus 82. The pouring ceases when the concrete mix reaches the top open end. Then, as shown in FIG. 7, concrete-filled casting apparatus 82 is mounted upside down upon stair-wall construction unit 10, supported by a previously installed precast step 18 along the length of step 20 and a previously installed wall block (not shown) along the width of step 72. Once precast step 20 has solidified, mold 86 is dislodged from frame 84 to release the step.

In one embodiment, steel reinforcement may be included to provide additional support to the stair-wall construction unit.

The dimensions provided herein of the wall blocks and precast steps generally comply with building safety standards in different countries. Furthermore, these dimensions provide advantages such as speed of construction, ease of installation for unskilled labor and self-builders and economy of the production scale. All dimensions provided are exemplary and other ranges and dimensions may be used.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A construction unit comprising:

a wall system having a plurality of T-shaped wall blocks arranged in a plurality of horizontal courses in Flemish bond, each of the T-shaped wall blocks having a main body portion, a side body portion and first and second intersecting corners, the main body portion having a rectangular cross section, a central portion, a first arm and a second arm extending horizontally from the central portion in opposing directions, wherein:

the side body portion has a square cross section emanating vertically from the central portion;

the first and second intersecting corners are disposed between the main body portion and the side body portion on both sides of the side body portion;

each of the T-shaped wall blocks, through the first and second arms, connects securely with the intersecting corners of two adjacent T-shaped wall blocks that are in the opposite orientation in the horizontal courses so that alternate T-shaped blocks in the horizontal courses have rectangular side surfaces and square side surfaces facing outward and square side surfaces in a first horizontal course are disposed in the middle of rectangular side surfaces of a second horizontal course below the first horizontal course; and a stair system having a plurality of precast concrete steps, each of the precast concrete steps including a generally horizontal tread portion, a riser portion connected integrally to the tread portion and a T-shaped connecting portion connected integrally to the tread portion and the riser portion, the T-shaped connecting portion having dimensions equal to the T-shaped wall blocks, each of the precast steps being installed by substituting a T-shaped wall block having the rectangular side surface outward with the T-shaped connecting portion so that the tread portion and the riser portion project perpendicularly out of the wall system.

2. The construction unit of claim 1, wherein each of the T-shaped wall blocks has dimensions of 400×200×200 mm (length×width×height).

3. The construction unit of claim 1, wherein the riser portion is generally vertically arranged and connected integrally at 90° and depends from the tread portion, and wherein the T-shaped connecting portion is connected integrally at 90° and depends from the tread portion and the riser portion.

4. The construction unit of claim 1, wherein the tread portion further includes a nosing portion.

5. The construction unit of claim 1, wherein the tread portion is 350-400 mm in width, 50 mm in height and 600-1200 mm in length.

6. The construction unit of claim 5, wherein the width is adjusted during casting with a casting apparatus.

7. The construction unit of claim 5, wherein the length is adjusted during casting with a casting apparatus.

8. The construction unit of claim 1, wherein the riser portion is 50 mm in width, 200 mm in height and 600-1200 mm in length.

9. The construction unit of claim 8, wherein the width is adjusted during casting with a casting apparatus.

10. The construction unit of claim 8, wherein the length is adjusted during casting with a casting apparatus.

11. The construction unit of claim 1, wherein the T-shaped wall blocks further include a T-shaped top surface and a T-shaped bottom surface which is opposite from the top surface at a distance equal to the height of the T-shaped wall blocks, a rectangular top central portion on the top surface, and a top circular groove disposed within the top central portion.

12. The construction unit of claim 1, wherein the T-shaped wall blocks further include a T-shaped top surface and a T-shaped bottom surface which is opposite from the top surface at a distance equal to the height of the T-shaped wall blocks, a rectangular bottom central portion on the bottom surface, and bottom circular grooves disposed on the bottom surface and located on both arms of the main body portion.

13. The construction unit of claim 12, wherein the rectangular bottom central portion includes a rectangular middle portion separating two rectangular grooves.

14. A precast concrete step comprising:

a horizontal tread portion;

a vertically arranged riser portion connected integrally to the tread portion at 90° and depending from the tread portion; and a T-shaped connecting portion including a main body portion having a rectangular side surface, wherein the rectangular side surface is connected integrally to the tread portion at 90° and depending from the tread portion and the riser portion, and wherein the T-shaped connecting portion has a T-shaped cross-section in a plane parallel to the horizontal tread portion.

15. The precast step of claim 14, wherein the tread portion further includes a nosing portion.

16. The precast step of claim 14, wherein the tread portion is 350-400 mm in width, 50 mm in height and 600-1200 mm in length.

17. The precast step of claim 16, wherein the width is adjusted during casting with a casting apparatus.

18. The precast step of claim 16, wherein the length is adjusted during casting with a casting apparatus.

19. The precast step of claim 14, wherein the riser portion is 50 mm in width, 200 mm in height and 600-1200 m in length.

20. The precast step of claim 19, wherein the width is adjusted during casting with a casting apparatus.

21. The precast step of claim 19, wherein the length is adjusted during casting with a casting apparatus.

22. The precast step of claim 14, wherein the T-shaped connecting portion further includes:

a central portion, a first arm and a second arm extending horizontally from the central portion in opposing directions;

a side body portion having a square cross section emanating vertically from the central portion; and first and second intersecting corners disposed between the main body portion and the side body portion on both sides of the side body portion.

23. The precast step of claim 22, wherein the T-shaped connecting portion has dimensions of 400×200×200 mm (length×width×height).

* * * * *